US007071877B2

(12) United States Patent
Okado

(10) Patent No.: US 7,071,877 B2
(45) Date of Patent: Jul. 4, 2006

(54) ANTENNA AND DIELECTRIC SUBSTRATE FOR ANTENNA

(75) Inventor: Hironori Okado, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 10/667,347

(22) Filed: Sep. 23, 2003

(65) Prior Publication Data

US 2004/0100409 A1 May 27, 2004

(30) Foreign Application Priority Data

Nov. 27, 2002 (JP) ..... 2002-343290
Mar. 4, 2003 (JP) ..... 2003-056740
Jun. 9, 2003 (JP) ..... 2003-163324

(51) Int. Cl.
*H01Q 1/26* (2006.01)

(52) U.S. Cl. ..... 343/700 MS; 343/846

(58) Field of Classification Search ..... 343/700 MS, 343/702, 769, 795, 846, 713, 829
See application file for complete search history.

(56) References Cited

U.S. PATENT DOCUMENTS 4,083,046 A 4/1978 Kaloi
4,151,531 A 4/1979 Kaloi
4,151,532 A * 4/1979 Kaloi ..... 343/700 MS
4,500,887 A 2/1985 Nester
4,605,012 A * 8/1986 Ringeisen et al. ..... 607/155
4,605,933 A 8/1986 Butscher ..... 343/700
5,255,002 A 10/1993 Day ..... 343/713
5,521,606 A 5/1996 Iijima et al. ..... 343/713
5,532,707 A 7/1996 Klinger et al.
5,847,682 A 12/1998 Ke (Continued)

FOREIGN PATENT DOCUMENTS

EP 0 831 548 A2 3/1998

(Continued)

OTHER PUBLICATIONS

Satoshi Honda et al.; Wideband Monopole Antenna of Circular Disc; ITEJ Technical Report; vol. 15, No. 59; Oct. 1991; pp 25-30.

(Continued)

*Primary Examiner*—Shih-Chao Chen
*Assistant Examiner*—Hung Tran Vy
(74) *Attorney, Agent, or Firm*—Oliff & Berridge, PLC

(57) ABSTRACT

This invention relates to a dual band antenna having a novel shape, which enables miniaturization and bandwidth widening. The antenna includes a dielectric substrate for an antenna including a layer of a planar element having a side edge portion constituted by either one of a curved line and line segments which are connected to each other while their inclinations are changed stepwise, and a substrate on which the dielectric substrate is placed and a ground pattern having a tapered shape with respect to the dielectric substrate is formed. The dielectric substrate and the ground pattern are juxtaposed, and a distance between the ground pattern and the side edge portion is continuously increased to become saturated as a point on the side edge portion moves away from a straight line passing through a feed position of the planar element. A resonant element is connected to the planar element at an end point of the planar element on the straight line passing through the feed position. By providing the resonant element, the dual band antenna can be realized. Besides, by the above structure, miniaturization of the antenna and bandwidth widening can be realized.

12 Claims, 10 Drawing Sheets

U.S. PATENT DOCUMENTS

| | | | | |
|---|---|---|---|---|
| 5,872,546 | A | 2/1999 | Ihara et al. | |
| 6,046,703 | A | 4/2000 | Wang et al. | |
| 6,097,345 | A * | 8/2000 | Walton | 343/769 |
| 6,133,879 | A | 10/2000 | Grangeat et al. | |
| 6,157,344 | A * | 12/2000 | Bateman et al. | 343/700 MS |
| 6,232,925 | B1 * | 5/2001 | Fujikawa | 343/702 |
| 6,249,254 | B1 * | 6/2001 | Bateman et al. | 343/700 MS |
| 6,259,416 | B1 | 7/2001 | Qi et al. | |
| 6,329,950 | B1 * | 12/2001 | Harrell et al. | 343/700 MS |
| 6,351,246 | B1 | 2/2002 | McCorkle | 343/700 MS |
| 6,452,548 | B1 | 9/2002 | Nagumo et al. | |
| 6,515,626 | B1 * | 2/2003 | Bark et al. | 343/700 MS |
| 6,603,429 | B1 * | 8/2003 | Bancroft et al. | 343/700 MS |
| 6,707,427 | B1 | 3/2004 | Konishi et al. | |
| 6,720,924 | B1 * | 4/2004 | Tomomatsu et al. | 343/700 MS |
| 6,747,600 | B1 | 6/2004 | Wong et al. | 343/700 |
| 6,747,605 | B1 * | 6/2004 | Lebaric et al. | 343/795 |
| 6,762,723 | B1 | 7/2004 | Nallo et al. | |
| 6,768,461 | B1 | 7/2004 | Huebner et al. | 343/700 |
| 2002/0015000 | A1 | 2/2002 | Reece et al. | |
| 2002/0026586 | A1 | 2/2002 | Ito | |
| 2002/0122010 | A1 | 9/2002 | McCorkle | 343/767 |
| 2003/0020668 | A1 | 1/2003 | Peterson | |
| 2003/0034920 | A1 | 2/2003 | Lee | |
| 2003/0156064 | A1 | 8/2003 | Bancroft et al. | |

FOREIGN PATENT DOCUMENTS

| | | |
|---|---|---|
| EP | 1 198 027 A1 | 4/2002 |
| JP | 31-709 | 1/1956 |
| JP | A 55-4109 | 1/1980 |
| JP | A 57-142003 | 9/1982 |
| JP | A 63-275204 | 11/1988 |
| JP | U 5-76109 | 10/1993 |
| JP | U-05-082122 | 11/1993 |
| JP | 06-291530 A | 10/1994 |
| JP | U 3008389 | 12/1994 |
| JP | A 8-213820 | 8/1996 |
| JP | A 11-27026 | 1/1999 |
| JP | 2000-183789 A | 6/2000 |
| JP | A 2001-156532 | 6/2001 |
| JP | A 2001-203529 | 7/2001 |
| JP | A 2001-217632 | 8/2001 |
| JP | 2002-100915 A | 4/2002 |
| JP | 2002-171126 A | 6/2002 |
| JP | 2002-252515 A | 9/2002 |
| JP | A 2002-319811 | 10/2002 |

OTHER PUBLICATIONS

Taisuke Ihara et al; "A Small Broadband Antenna with Rounded Semi-Circuler Element"; 1996; pp 78.

Taisuke Ihara et al; "Broadband Characteristics of Semi-Circuler Antenna combined with Linear Element"; General Convention of the Society of Electronics, Information and Communication Engineers; 1996; pp 77 w/translation.

Satoshi Honda et al; Improved Input Impedance of Circular Disc Monopole Antenna; 1992; pp 2-131.

U.S. Appl. No. 10/657,108, filed Sep. 2003, Okado.

U.S. Appl. No. 10/655,304, filed Sep. 2003, Okado.

* cited by examiner dBi
| PLANE | POLARIZED ELECTROMAGNETIC RADIATION | FREQUENCY(GHz) | |
|---|---|---|---|
| | | 2.45 | 5.4 |
| YZ | V | −7.1 | −9.9 |
| | H | −2.2 | −0.8 |
| XZ | V | 0.6 | −3.7 |
| | H | −8.2 | −7.2 |
| XY | V | −14.5 | −12.8 |
| | H | −2.1 | −0.7 |
| TOTAL AVERAGE | | −3.4 | −3.9 |
FIG.10
FIG.11A
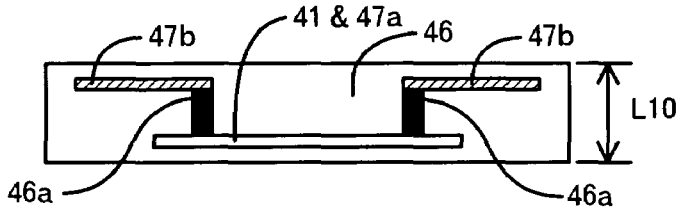
FIG.11B
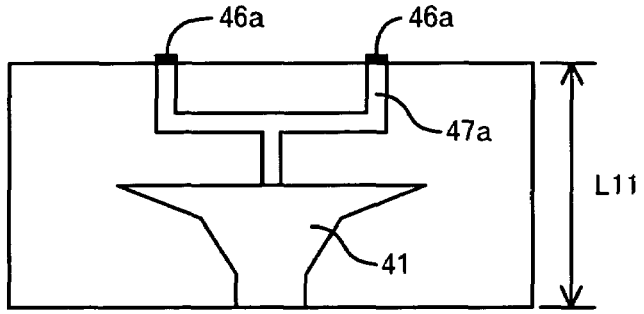
FIG.11C
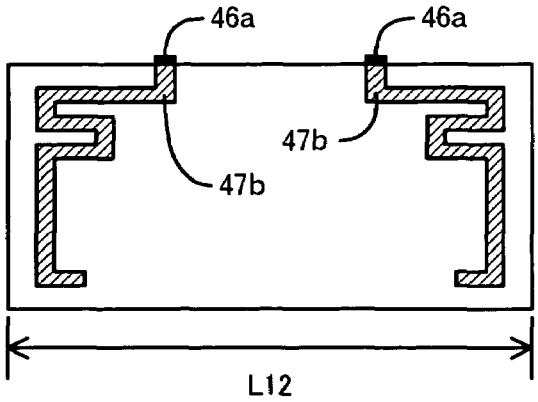

ANTENNA AND DIELECTRIC SUBSTRATE FOR ANTENNA

TECHNICAL FIELD OF THE INVENTION

The present invention relates to a wide bandwidth antenna, a dual band antenna and a dielectric substrate used for those antennas.

BACKGROUND OF THE INVENTION

For example, a monopole antenna as shown in FIG. 16A is disclosed in "B-77: BROADBAND CHARACTERISTICS OF SEMI-CIRCULAR ANTENNA COMBINED WITH LINEAR ELEMENT", Taisuke Ihara, Makoto Kijima and Koichi Tsunekawa, pp77 General Convention of The Institute of Electronics, Information and Communication Engineers, 1996 (hereinafter referred to as "non-patent document 1"). In FIG. 16A, a semicircular element 1010 is erected vertically to a earth plate 1011, and the closest point of the arc of the element 1010 to the earth plate 1011 serves as a feed portion 1012. The non-patent document 1 discloses that a frequency $f_L$ at which the radius of the circle corresponds approximately to a quarter wavelength is the lower limit. Besides, it describes an example in which as shown in FIG. 16B, an element 1013 where a cut-out portion is provided for the element 1010 shown in FIG. 16A is erected vertically to the earth plate 1011, and that VSWR (Voltage Standing Wave Ratio) characteristics of the monopole antenna of FIG. 16A and the monopole antenna of FIG. 16B are almost identical to each other. Further, it also discloses an example in which as shown in FIG. 16C, an element 1014 in which an element 1014*a*, which resonates at a frequency lower than $f_L$ and has a meander monopole structure, is connected to an element with a cut-out portion as shown in FIG. 16B is erected vertically to the earth plate 1011. Incidentally, the element 1014*a* is disposed to be accommodated in the cut-out portion. By the element 1014*a*, the antenna also resonates at a frequency lower than $f_L$, and multi-resonance is realized, however, the VSWR characteristic in a frequency range lower than $f_L$ is poor, and sufficient characteristics for use in a dual band antenna are not achieved.

Besides, U.S. Pat. No. 6,515,626 discloses a microstrip patch antenna 1100 as shown in FIG. 17. The microstrip patch antenna 1100 is such that a ground plane 1140, a microstrip patch 1120, and a triangular pad (feed conductor) 1130 connected to the microstrip patch 1120 are formed of conductive metal on a dielectric substrate 1110. Incidentally, the microstrip patch 1120 is fed from a feed point 1150 through the triangular pad 1130 as a feed conductor. Although not shown, from the operation principle of the microstrip antenna, the microstrip patch antenna 1100 as shown in FIG. 17 is not suitably operated unless the ground is disposed opposite to the dielectric substrate 1110. Besides, since the area of the ground plane 1140 is very small, it is not conceivable that the ground plane functions as a radiant element. Further, in the microstrip antenna, a current flowing in the radiation conductor is not a direct radiation source, and in FIG. 17, a current flowing in the triangular pad 1130 and the microstrip patch 1120 does not serve as a direct radiation source. Besides, a reception frequency bandwidth of the microstrip patch antenna 1100 disclosed in this publication is as narrow as 200 MHz with respect to the center frequency of 1.8 GHz, the triangular pad 1130 does not function as the radiation conductor, and it is conceivable that the microstrip patch 1120 is a radiation conductor of a single frequency (1.8 GHz). As stated above, the microstrip patch antenna 1100 shown in FIG. 17 is a microstrip antenna and is not a monopole antenna in which a current flowing in the radiation conductor contributes to radiation. Besides, it is not a traveling-wave antenna in which the wide bandwidth is realized by continuously changing a current path flowing in a radiation conductor. Further, since the reception frequency range is single, it is not a dual band antenna.

As stated above, although there are various antennas up to now, since the conductor in the conventional monopole antenna disclosed in the non-patent document 1 is erected vertically to the earth plate, the size of the antenna becomes large.

Besides, in the antenna disclosed in the non-patent document 1, as set forth above, although multi-resonance is realized in plural frequency ranges, antenna characteristics that are presently demanded as the dual band antenna are not obtained.

Further, with respect to the microstrip antenna disclosed in U.S. Pat. No. 6,515,626, although the shape appears to be such that both the triangular pad and the microstrip patch contribute to radiation, the triangular pad does not serve as the radiation conductor, but is merely the feed conductor. Thus, this antenna is the antenna in which the reception frequency range is single, and is not the dual band antenna.

SUMMARY OF THE INVENTION

In view of the foregoing problems, an object of this invention is to provide an antenna having a novel shape, which enables miniaturization and bandwidth widening, and a dielectric substrate for the antenna.

Besides, another object of this invention is to provide a dual band antenna having a novel shape, which enables miniaturization and has sufficient antenna characteristics, and a dielectric substrate for the dual band antenna.

An antenna according to a first aspect of this invention includes a planar element that is fed at a feed position, and a ground pattern that is juxtaposed with the planar element, and wherein as being farther away from a straight line passing through the feed position, a distance between the planar element and the ground pattern is gradually increased to become saturated. By juxtaposing the ground pattern with the planar element, miniaturization of the antenna becomes possible.

Besides, a side edge portion of the planar element may be constituted by either one of a curved line and line segments which are connected while their inclinations are changed stepwise, and the planar element may be formed on or inside a dielectric substrate for an antenna.

When the planar element is formed on or inside the dielectric substrate for the antenna, further miniaturization of the antenna becomes possible. However, when the planar element is formed on or inside the dielectric substrate for the antenna, the coupling of the planar element and the ground pattern becomes strong, and the adjustment of the distance between them becomes necessary. Then, the shape of the side edge portion of the planar element is formed as stated above, and the distance between the planar element and the ground pattern is adjusted, so that the coupling degree is optimized, and the wide bandwidth can be realized.

Besides, a side of the ground pattern opposite to the dielectric substrate for the antenna may be constituted by a line segment. This indicates a case where the adjustment of the distance between the planar element and the ground pattern is mainly performed by the shape of the planar element.

Further, the ground pattern may have a tapered shape with respect to the dielectric substrate for the antenna, and the tapered shape may be constituted by line segments. By adjusting the shape of the ground pattern as stated above, an antenna characteristic, especially an impedance characteristic, is improved.

Besides, the planar element may be symmetrical with respect to the straight line passing through the feed position of the planar element.

Further, the dielectric substrate for the antenna may further include a resonant element connected to an end point of the planar element on the straight line passing through the feed position. By providing the resonant element as stated above, a dual band antenna can be realized.

Besides, the resonant element may be symmetrical with respect to the straight line passing through the feed position of the planar element. Besides, it may be asymmetrical.

Further, the planar element and the resonant element may be formed in a same layer of the dielectric substrate for the antenna.

Besides, the planar element and at least a part of the resonant element may be formed in different layers. By this structure, the dielectric substrate for the antenna can be miniaturized and the antenna can also be miniaturized as a whole.

Further, when the planar element and the resonant element are projected on a virtual plane parallel to the layers in which the respective elements are formed, the resonant element may be disposed without overlapping with a predetermined region defined beside the planar element projected on the virtual plane. Besides, the resonant element may be disposed without overlapping with at least a region at a planar element side with respect to a half line, which is parallel to the straight line passing through the feed position of the planar element projected on the virtual plane and extends in a feed position direction from a start point that is an end point of the side edge portion of the projected planar element and is a point remoter from the feed position.

By disposing the resonant element as stated above, the characteristics of the planar element and the resonant element can be separately controlled without exerting a bad influence on the characteristic of the planar element.

A dielectric substrate for an antenna according to a second aspect of this invention comprises a dielectric layer, and a layer including a conductive planar element having a side edge portion constituted by either one of a curved line and line segments, which are connected while their inclinations are changed stepwise, and wherein a distance between a side surface closest to a feed position of the planar element among side surfaces of the dielectric substrate for the antenna and the side edge portion is gradually increased to become saturated as being farther away from a straight line passing through the feed position.

By making the dielectric substrate for the antenna include the layer of the planar element, miniaturization of the antenna becomes possible.

Besides, the planar element may be symmetrical with respect to the straight line passing through the feed position of the planar element.

Further, the second aspect of this invention may further include a resonant element connected to an end point of the planar element on the straight line passing though the feed position of the planar element. By providing the resonant element as stated above, a dual band antenna can be realized.

Besides, the resonant element may be symmetrical with respect to the straight line passing through the feed position of the planar element. Besides, it may be asymmetrical.

Further, the planar element and the resonant element may be formed in a same layer of the dielectric substrate.

Besides, the planar element and at least a part of the resonant element may be formed in different layers of the dielectric substrate. By this structure, the dielectric substrate for the antenna can be miniaturized.

Further, when the planar element and the resonant element are projected on a virtual plane parallel to the layers in which the respective elements are formed, the resonant element may be disposed without overlapping with a predetermined region defined beside the planar element projected on the virtual plane. Besides, the resonant element may be disposed without overlapping with at least a region at a planar element side with respect to a half line, which is parallel to the straight line passing through the feed position of the planar element projected on the virtual plane and extends in a feed position direction from a start point that is an end point of the side edge portion of the projected planar element and is a point remoter from the feed position.

By disposing the resonant element as stated above, the characteristics of the planar element and the resonant element can be separately controlled without exerting a bad influence on the characteristic of the planar element.

Incidentally, it can be said that the ground pattern and the planar element or the dielectric substrate for the antenna are in a non-opposite state, and the respective planes are parallel or substantially parallel to each other. Besides, it can be said that the ground pattern and the planar element or the dielectric substrate for the antenna do not completely overlap with each other, and the respective planes are parallel or substantially parallel to each other.

BRIEF DESCRIPTION OF THE DRAWINGS

FIG. 10 is a diagram showing a gain characteristic in the fourth embodiment of this invention;

FIGS. 11A, 11B and 11C are diagrams showing a layer structural example of a dielectric substrate for an antenna according to a fifth embodiment of this invention;

DETAILE DESCRIPTION OF THE PREFERRED EMBODIMENTS

Preferred embodiments according to the present invention will be described with reference to the accompanying drawings.

1. First Embodiment

Figure 1A:
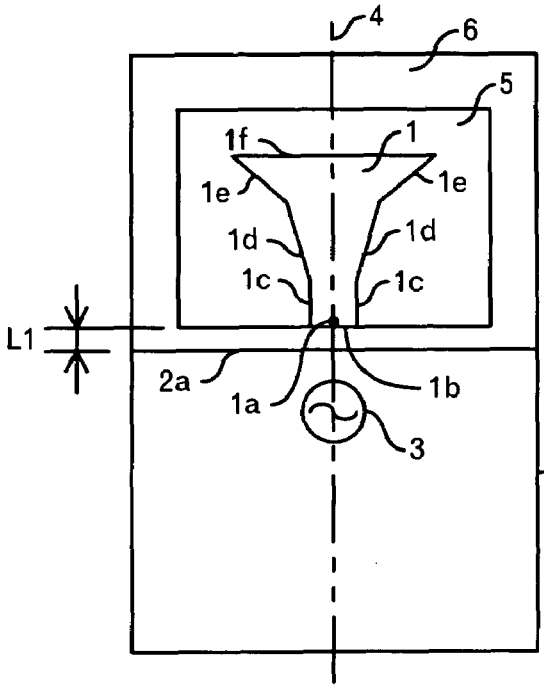
FIG. 1A is a front view showing the structure of an antenna in a first embodiment of this invention.
Figure 1B:
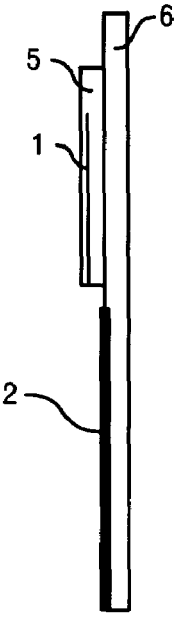
FIG. 1B is a side view thereof.

FIGS. 1A and 1B show the structure of an antenna of a first embodiment of this invention. As shown in FIG. 1A, the antenna of this embodiment is constituted by a dielectric substrate 5 including a planar element 1 in the inside thereof and having a dielectric constant of about 20, a ground pattern 2 juxtaposed with the dielectric substrate 5, a substrate 6, for example, a printed circuit board (more specifically, a resin substrate made of FR-4, Teflon (registered trademark) or the like), and a high frequency power source 3 connected to a feed point 1*a* of the planar element 1. The planar element 1 has a shape similar to a T shape, and is constituted by a bottom side 1*b* along an end portion of the dielectric substrate 5, sides 1*c* extending upward, sides 1*d* having a first inclination angle from the sides 1*c*, sides 1*e* having an inclination angle larger than the first inclination angle from the sides 1*c*, and a top portion 1*f*. The feed point 1*a* is provided at the middle point of the bottom side 1*b* along the end portion of the dielectric substrate 5. In this embodiment, a distance L1 between the dielectric substrate 5 and the ground pattern 2 is 1.5 mm. Besides, the width of the ground pattern 2 is 20 mm.

Besides, the planar element 1 and the ground pattern 2 are symmetrical with respect to a straight line 4 passing through the feed point 1*a*. Besides, a length (hereinafter referred to as a distance) of a line segment extending from a point on the sides 1*c*, 1*d* and 1*e* of the planar element 1 to the ground pattern 2 in parallel to the straight line 4 is symmetrical with respect to the straight line 4. That is, when intervals between the points on the sides and the straight line 4 are identical, the distances become identical.

In this embodiment, a side 2*a* of the ground pattern 2 facing the dielectric substrate 5 is a straight line. Accordingly, the distance is gradually increased as an arbitrary point on the sides 1*c*, 1*d* and 1*e* moves on the sides 1*c*, 1*d* and 1*e*. That is, as the arbitrary point moves away from the straight line 4, the distance is increased.

Although a polygonal line constituted by connecting the sides 1*c*, 1*d* and 1*e* is not a curved line, the inclination of each side is changed stepwise so that the distance is increased to become saturated. In other words, when the point moves away from the straight line 4 along the polygonal line, although the distance is rapidly increased at first, the increase rate is gradually decreased. That is, the shape is such that shaving is performed inward from a straight line connecting an end point of the top portion 1*f* and an end point of the bottom side 1*b*, which are positioned at the same side when viewed from the straight line 4.

In this embodiment, the side edge portion of the planar element 1 opposite to the side 2*a* of the ground pattern 2 is constituted by the three line segments 1*c*, 1*d* and 1*e*. However, as long as the condition that the distance is increased to become saturated is satisfied, the shape of the side edge portion is not limited to this. Instead of the sides 1*c*, 1*d* and 1*e*, a polygonal line constituted by an arbitrary number of line segments not less than two may be adopted. Besides, instead of the sides 1*c*, 1*d* and 1*e*, the side edge portion may be a curved line convex upwardly with respect to the straight line connecting the end point of the top portion 1*f* and the end point of the bottom side 1*b*, which are positioned at the same side when viewed from the straight line 4. That is, when viewed from the planar element 1, the curved line is convex inwardly.

Even when any shape is adopted, as the point moves away from the straight line 4 along the sides 1*c*, 1*d* and 1*e*, the distance is continuously changed, and by the existence of the continuous changing portion, a continuous resonance characteristic can be obtained at the lower limit frequency or higher. Incidentally, the lower limit frequency is adjusted by changing the height of the planar element 1. However, it can also be controlled by the length of the top portion 1*f*, and/or the shape and length of the side edge portions with the reverse arc shape.

FIG. 1B is a side view in which the ground pattern 2 and the dielectric substrate 5 are provided on the substrate 6. There is also a case where the substrate 6 and the ground pattern 2 are integrally formed. Incidentally, in this embodiment, the planar element 1 is formed in the inside of the dielectric substrate 5. That is, the dielectric substrate 5 is formed by laminating ceramic sheets, and the conductive planar element 1 is also formed as one layer of them. Accordingly, actually, even if viewed from the above, it cannot be viewed as in FIG. 1A. When the planar element 1 is constructed in the inside of the dielectric substrate 5, as compared with a case of exposure, an effect of the dielectric is slightly enhanced, and therefore, the miniaturization can be achieved, and the reliability and/or resistance against rust or the like is also increased. However, the planar element 1 may be formed on the surface of the dielectric substrate 5. Besides, the dielectric constant can also be changed, and either of a single layer substrate and a multilayer substrate may be used. In the case of the single layer substrate, the planar element 1 is formed on the dielectric substrate 5. Incidentally, in this embodiment, the plane of the dielectric substrate 5 is disposed parallel to or substantially parallel to the plane of the ground pattern 2. By this arrangement, the plane of the planar element 1 included in the one layer of the dielectric substrate 5 also becomes parallel to or substantially parallel to the plane of the ground pattern 2.

As stated above, when the planar element 1 is formed so as to be covered with the dielectric substrate 5, the state of an electromagnetic field around the planar element 1 is changed by the dielectric. Specifically, since an effect of increasing the density of the electric field in the dielectric and a wavelength shortening effect can be obtained, the planar element 1 can be miniaturized. Besides, by these effects, a lift-off angle of a current path is changed, and an inductance component L and a capacitance component C in an impedance equivalent circuit of the antenna are changed. That is, a great influence occurs on the impedance characteristic. When the shape is optimized so as to obtain a desired impedance characteristic in the bandwidth from 4.9 GHz to 5.8 GHz in consideration of the influence on this impedance characteristic, the shape as shown in FIG. 1A has been obtained. This bandwidth is very wide as compared with the prior art.

Incidentally, it is conceivable that the planar element 1 is a radiation conductor of a monopole antenna similarly to the prior art. On the other hand, it can be said that the antenna of this embodiment is a dipole antenna since the ground pattern 2 also contributes to radiation. However, since the dipole antenna normally uses two radiation conductors having the same shape, the antenna of this embodiment can also be said an asymmetrical dipole antenna. Further, the antenna of this embodiment can also be said a traveling-wave antenna. The point of view as stated above can be applied to all embodiments described below.

2. Embodiment 2

Figure 2:
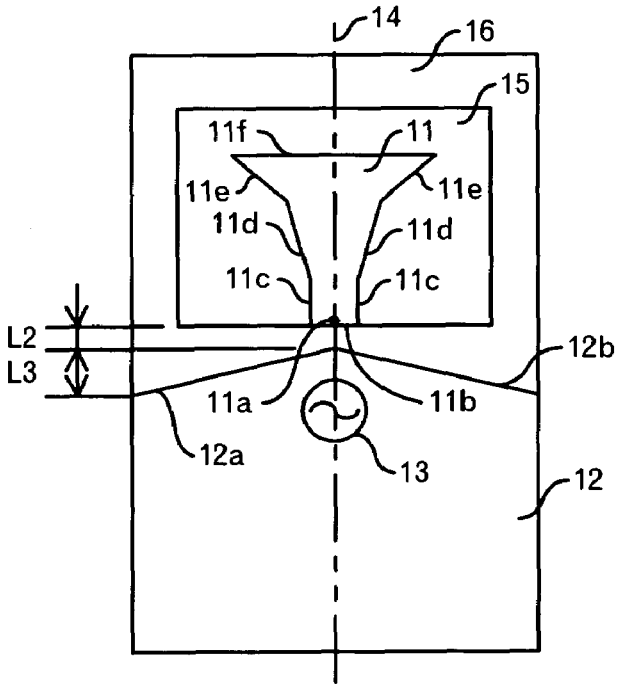
FIG. 2 is a diagram showing the structure of an antenna in a second embodiment of this invention.

FIG. 2 shows a structure of an antenna of a second embodiment of this invention. As shown in FIG. 2, the antenna of this embodiment is constituted by a dielectric substrate 15 including a planar element 11 in the inside thereof and having a dielectric constant of about 20, a ground pattern 12 juxtaposed with the dielectric substrate 15, a substrate 16, for example, a printed circuit board, and a high frequency power source 13 connected to a feed point 11*a* of the planar element 11. The planar element 11 and the dielectric substrate 15 are the same as the planar element 1 and the dielectric substrate 5 of the first embodiment. In this embodiment, a distance L2 between the dielectric substrate 15 and the ground pattern 12 is 1.5 mm. Besides, the width of the ground pattern 12 is 20 mm.

Besides, the planar element 11 and the ground pattern 12 are symmetrical with respect to a straight line 14 passing through the feed point 11*a*. Besides, a length (hereinafter referred to as a distance) of a line segment extending from a point on sides 11*c*, 11*d* and 11*e* of the planar element 11 to the ground pattern 12 in parallel to the straight line 14 is also symmetrical with respect to the straight line 14. That is, when intervals between the points on the sides 11*c*, 11*d* and 11*e* and the straight line 14 are identical, the distances become identical.

In this embodiment, sides 12*a* and 12*b* of the ground pattern 12 facing the dielectric substrate 15 are inclined so that as the point moves away from the straight line 14 along the sides 11*c*, 11*d* and 11*e*, the distance between the planar element 11 and the ground pattern 12 becomes long. In this embodiment, the height at the side edge portion of the ground pattern 12 is lower than the height of a cross point of the ground pattern and the straight line 14 by a length L3 (=2 to 3 mm). That is, the ground pattern 12 has a tapered shape formed of the upper edge portions 12*a* and 12*b* with respect to the dielectric substrate 15. The structure of the side surface is similar to FIG. 1B.

It is confirmed that when the sides 12*a* and 12*b* of the ground pattern 12 are inclined as in this embodiment, in the bandwidth from 4.9 GHz to 5.8 GHz, the impedance characteristic is better than the antenna of the first embodiment.

3. Embodiment 3

Figure 3:
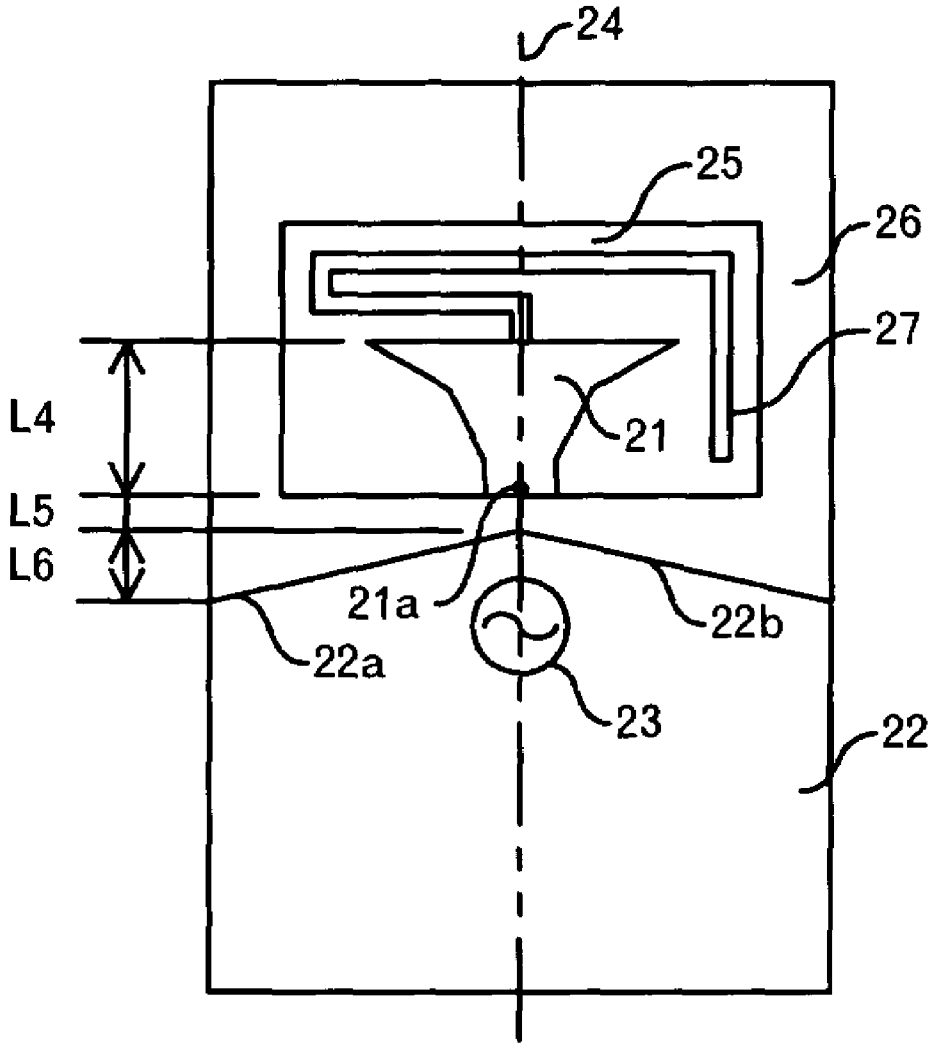
FIG. 3 is a diagram showing the structure of an antenna of a third embodiment of this invention.

An antenna of a third embodiment of this invention is a dual band antenna for a 2.4 GHz band and a 5 GHz band. As shown in FIG. 3, the dual band antenna is constituted by a dielectric substrate 25 including in the inside thereof a planar first element 21 and a second element 27 as a resonant element extending from a center of a top of the first element 21, a ground pattern 22 juxtaposed with the dielectric substrate 25, disposed therefrom by an interval L5 (=1.5 mm) and having an upper edge portion of a tapered shape with respect to the dielectric substrate 25, a substrate 26 on which the dielectric substrate 25 and the ground pattern 22 are placed, and a high frequency power source 23 connected to a feed point 21*a* provided at the central portion of a bottom of the first element 21. The size of the dielectric substrate 25 is, for example, 8 mm×4.5 mm×1 mm. Incidentally, the ground pattern 22 may be formed inside the substrate 26.

The first element 21 has a shape similar to a T shape, and specifically, has a shape similar to the planar element 1 shown in FIG. 1A. Bandwidth control of the 5 GHz band is performed by a height L4 of this first element 21. However, the bandwidth can also be controlled by the length of a side of a top portion and/or the shape and length of side edge portions with a reverse arc shape.

The ground pattern 22 has a width of 20 mm, and the height at both side edge portions of the ground pattern 22 is lower than the height of a cross point of the ground pattern 22 and a straight line 24 passing through the feed point 21*a* by L6 (=2 to 3 mm). That is, the ground pattern 22 has a tapered shape formed of upper edge portions 22*a* and 22*b* with respect to the dielectric substrate 25. The structure of the side surface is almost similar to FIG. 1B except for the portion of the second element 27. However, the second element 27 is provided in the same layer as the first element 21.

The first element 21 and the ground pattern 22 are symmetrical with respect to the straight line 24. Besides, a length (hereinafter referred to as a distance) of a line segment extending from a point on the side edge portions of the first element 21 to the ground pattern 22 in parallel to the straight line 24 is also symmetrical with respect to the straight line 24. Further, the distance is gradually increased as the point on the side edge portions of the first element 21 moves away from the straight line 24.

The impedance characteristic is controlled by the shapes of the first element 21 and the ground pattern 22 as stated above. Besides, the resonant frequency of the 2.4 GHz band is controlled by adjusting the length of the second element 27 from a connected portion with the first element 21 to an open end. Incidentally, the second element 27 has a bent shape so that miniaturization is achieved without exerting a bad influence on the characteristic of the first element 21.

By adopting the shapes as stated above, the electric characteristics of the 5 GHz band and the 2.4 GHz band can be separately controlled. The 5 GHz band and the 2.4 GHz band are ranges used in the standard of wireless LAN (Local Area Network), and this embodiment capable of supporting both the frequency ranges is very useful.

4. Embodiment 4

Figure 4:
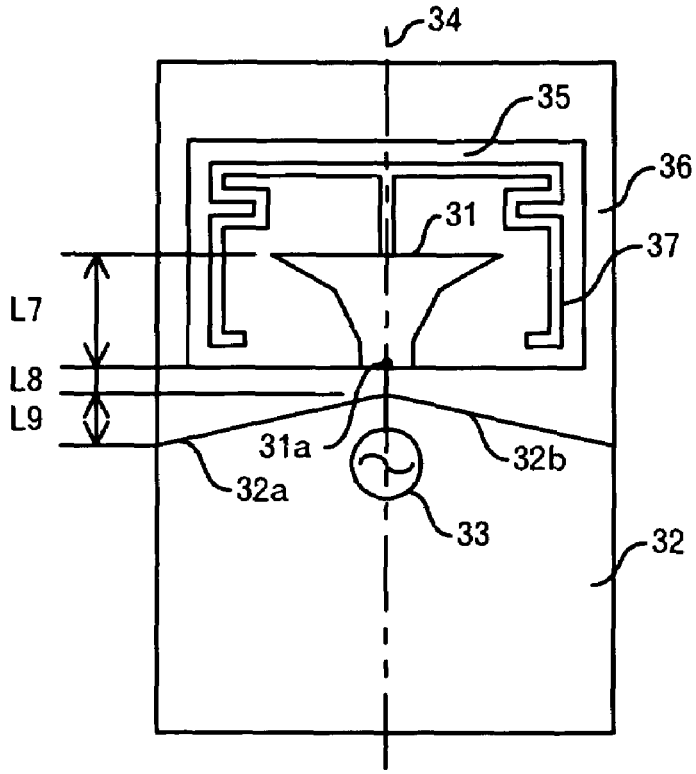
FIG. 4 is a diagram showing the structure of an antenna of a fourth embodiment of the invention.

An antenna of a fourth embodiment of this invention is a dual band antenna for a 2.4 GHz band and a 5 GHz band. The dual band antenna is constituted by, as shown in FIG. 4, a dielectric substrate 35 including in the inside thereof a planar first element 31 and a second element 37 as a resonant element extending from a center of a top of the first element 31, a ground pattern 32 juxtaposed with the dielectric substrate 35, disposed therefrom by an interval L8 (=1.5 mm) and having an upper edge portion of a tapered shape with respect to the dielectric substrate 35, a substrate 36 on which the dielectric substrate 35 and the ground pattern 32 are placed, and a high frequency power source 33 connected to a feed point 31*a* provided at the central portion of a bottom of the first element 31. The size of the dielectric substrate 35 is, for example, 10 mm×5 mm×1 mm.

The first element 31 has a shape similar to a T shape, and more specifically has a shape similar to the planar element 1 shown in FIG. 1A. The bandwidth control of the 5 GHz band is performed by a height L7 of the first element 31. However, it can also be controlled by the length of a side of a top portion, and/or the shape and length of side edge portions with a reverse arc shape.

The ground pattern 32 has a width of 20 mm, and the height of the side edge portions of the ground pattern 32 are lower than the height of a cross point of the ground pattern and a straight line 34 passing through the feed point 31*a* by L9 (=2 to 3 mm). That is, the ground pattern 32 has a tapered shape formed of upper edge portions 32*a* and 32*b* with respect to the dielectric substrate 35. The structure of the side surface is almost similar to FIG. 1B except for the portion of the second element 37. However, the second element 37 is provided in the same layer as the first element 31.

The first element 31, the second element 37, and the ground pattern 32 are symmetrical with respect to the straight line 34. Besides, a length (hereinafter referred to as a distance) of a line segment extending from a point on the side edge portion of the first element 31 to the ground pattern 32 in parallel to the straight line 34 is also symmetrical with respect to the straight line 34. Further, the distance is gradually increased as the point on the side edge portions of the first element 31 moves away from the straight line 34.

Figure 5:
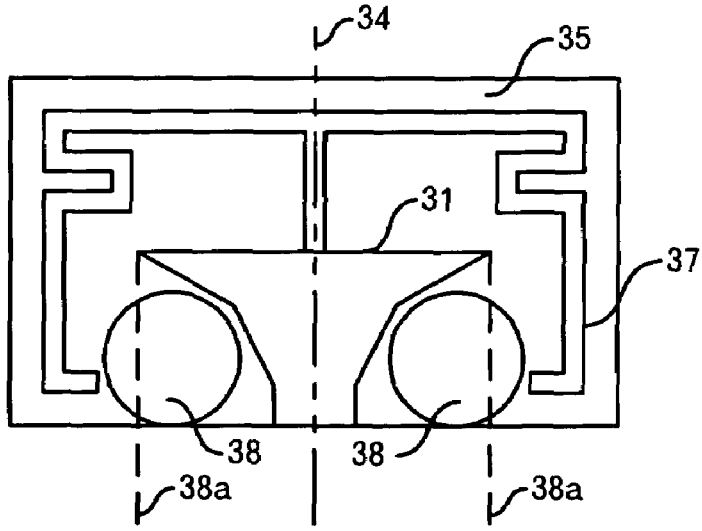
FIG. 5 is a diagram for explaining a region where a second element exerts an influence on a first element.

The impedance characteristic is controlled by the shapes of the first element 31 and the ground pattern 32 as set forth above. The resonant frequency of the 2.4 GHz band is controlled by adjusting the length of the second element 37 from a connected portion with the first element 31 to an open end. Incidentally, a meander portion of the second element 37 is formed at upper side of the dielectric substrate. This is for carrying out an efficient arrangement in a limited space while a bad influence is not exerted on the characteristic of the first element 31. As shown in FIG. 5, a space 38 is a portion where a bad influence is exerted on the characteristic of the first element 31, and the second element 37 is not disposed in this portion. Besides, the second element 37 is not disposed in at least a region closer to the first element 31 than a dotted line 38*a*. This dotted line 38*a* is a half line extending in parallel to the straight line 34 toward the feed point 31*a* from a start point that is an end point of the side edge portion of the first element 31 and is remoter from the feed point 31*a*.

By adopting the shape as stated above, the electrical characteristics of the 5 GHz band and the 2.4 GHz band can be separately controlled. The 5 GHz band and the 2.4 GHz band are ranges used in the standard of wireless LAN, and this embodiment capable of supporting both the frequency bands is very useful.

Figures 6A, 6B:
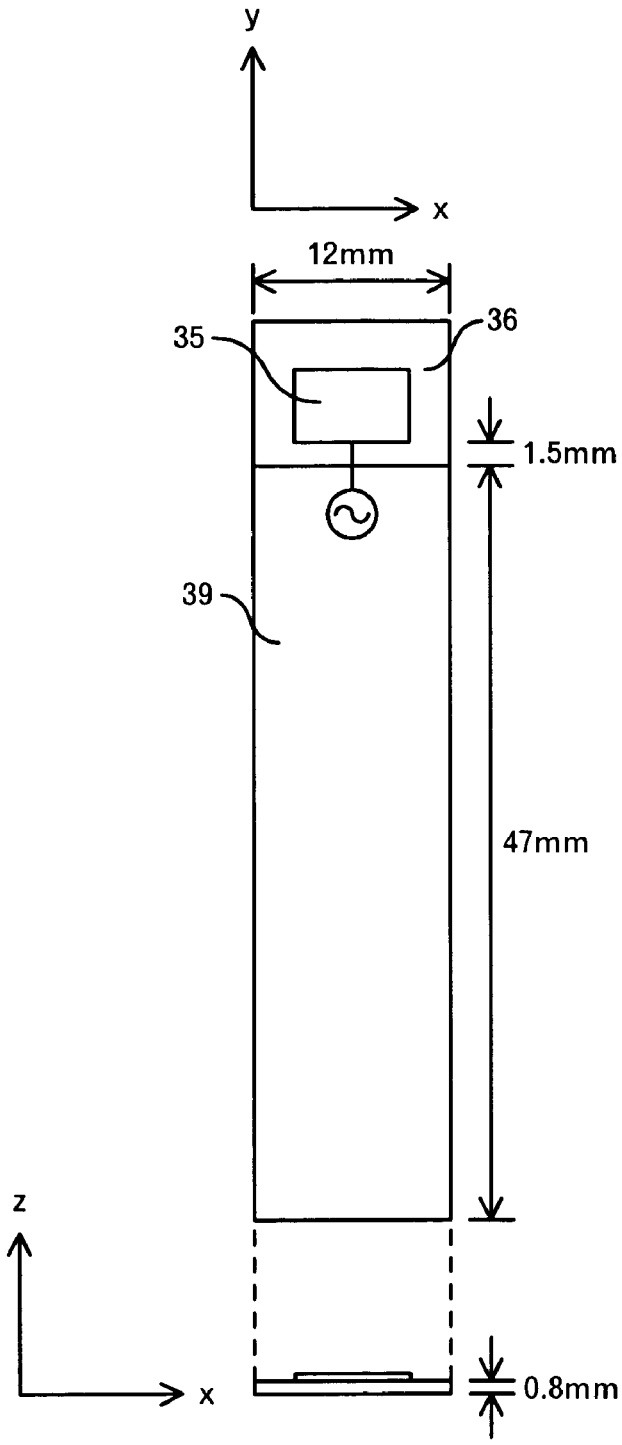
FIG. 6A is a front view showing a mounting example in the fourth embodiment of this invention.
FIG. 6B is a bottom view thereof.

Antenna characteristics in a case where for example, an implementation form as shown in FIGS. 6A and 6B is adopted will be given. As shown in FIGS. 6A and 6B, the dielectric substrate 35 is juxtaposed with a ground pattern 39 whose upper edge portion is horizontal and is disposed therefrom by an interval of 1.5 mm. As shown in FIG. 4, the size of the dielectric substrate 35 is 10 mm×5 mm×1 mm, and includes the first element 31 and the second element 37. On the other hand, as for the size of the ground pattern 39, the height is 47 mm and the width is 12 mm. The thickness of the substrate 36 is 0.8 mm. Incidentally, it is assumed that the drawing shown in FIG. 6A is an XY plane, and the drawing shown in FIG. 6B is an XZ plane.

Figure 7:
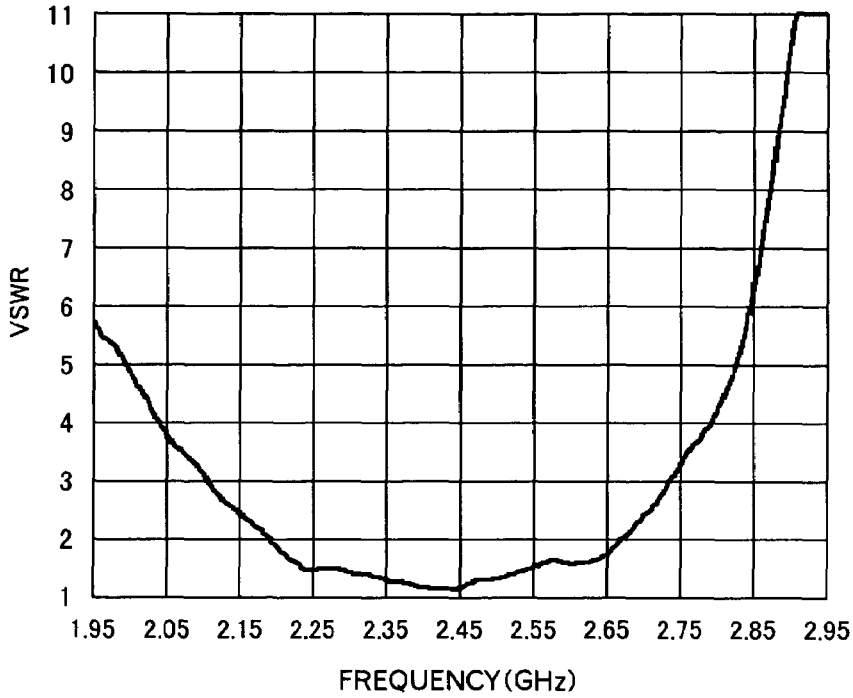
FIG. 7 is a diagram showing an impedance characteristic of a 2.4 GHz band in the fourth embodiment of this invention.
Figure 8:
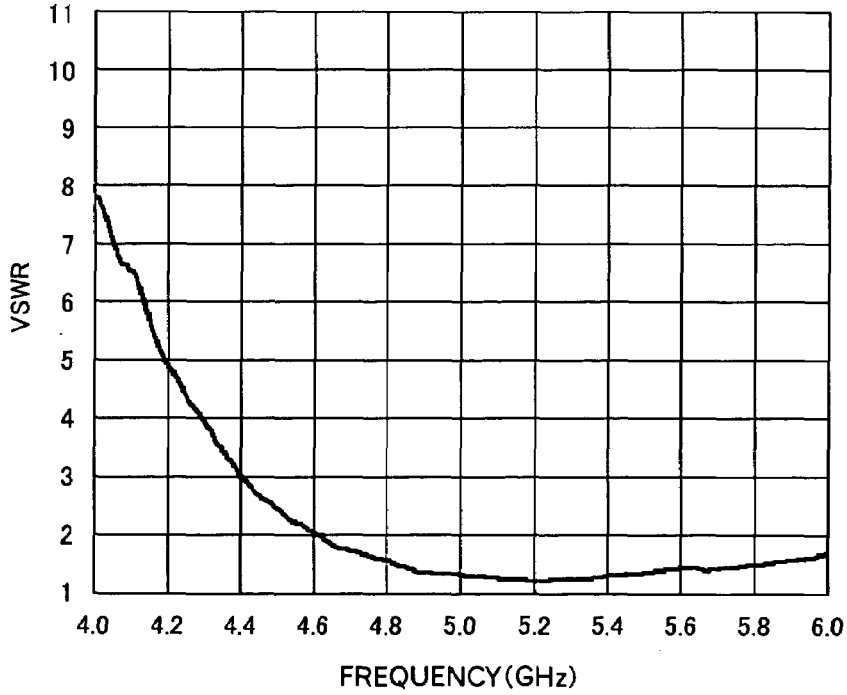
FIG. 8 is a diagram showing an impedance characteristic of a 5 GHz band in the fourth embodiment of this invention.

At this time, the impedance characteristic of the second element 37 is as shown in FIG. 7. In FIG. 7, the axis of ordinate indicates the VSWR, and the axis of abscissa indicates the frequency (GHz). The frequency at which the VSWR is smallest is about 2.45 GHz, and the frequency bandwidth in which the VSWR is 2 or less is from about 2.20 GHz to 2.67 GHz, so that about 470 MHz is secured. On the other hand, the impedance characteristic of the first element 31 is as shown in FIG. 8. The frequency at which the VSWR is smallest is about 5.2 GHz, and the frequency bandwidth in which the VSWR is 2 or less is about 4.6 GHz to 6 GHz or more, so that at least 1.4 GHz is secured. As stated above, the wide bandwidth is realized for both the second element 37 and the first element 31. That is, it is indicated that the antenna of the embodiment has a sufficient function as the dual band antenna. Incidentally, the ground pattern 39 may be tapered toward the dielectric substrate 35.

Figure 9A:
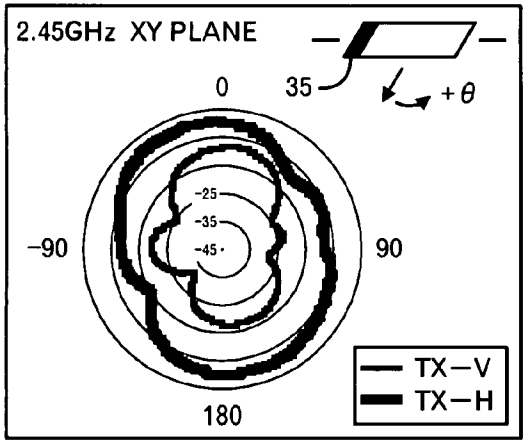
FIGS. 9A, 9B and 9C are diagrams showing radiation patterns with respect to the electric wave of 2.45 GHz.

Besides, the directivity of the antenna shown in FIGS. 6A and 6B will be shown in FIGS. 9A to 9F. FIG. 9A shows radiation patterns when electric waves of 2.45 GHz are transmitted from a transmission side antenna, and the reception side antenna shown in FIGS. 6A and 6B is rotated while a measurement plane is set to the XY plane. Incidentally, with respect to concentric circles, the center indicates −45 dBi, the outermost circle indicates 5 dBi, and an interval between the respective circles is 10 dBi. Here, an inside solid line indicates the radiation pattern of the reception side antenna in the case where the electric wave of the vertical polarization is transmitted from the transmission side antenna, and an outside thick line indicates the radiation pattern of the reception side antenna in the case where the electric wave of the horizontal polarization is transmitted from the transmission side antenna. It is understood that the radiation pattern for the horizontally polarized wave shows larger gain in all directions. Besides, in the case of the vertically polarized wave, it appears that there is directivity in directions of 0°, −90° and 180°. Incidentally, an upper right picture shows the antenna of FIGS. 6A and 6B. A blackened portion is a position where the dielectric substrate 35 is placed. A vertical arrow indicates a direction of 0°, and an angle is increased in a direction of +θ.

Figure 9B:
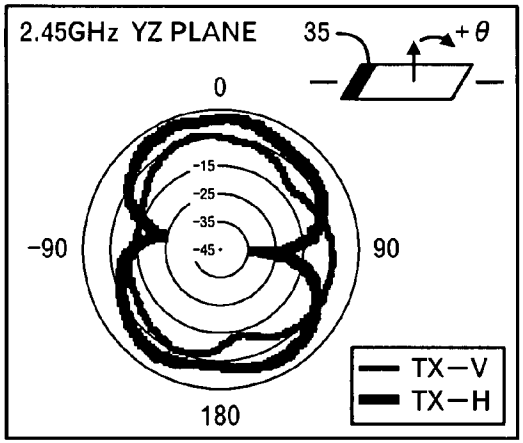

Similarly, FIG. 9B shows radiation patterns when electric waves of 2.45 GHz are transmitted from the transmission side antenna, and the reception side antenna shown in FIGS. 6A and 6B is rotated while the YZ plane is set to a measurement plane. Similarly to the above, a solid line indicates the radiation pattern of the reception side antenna in the case where the electric wave of the vertically polarization is transmitted from the transmission side antenna, and a thick line indicates the radiation pattern of the reception side antenna in the case where the electric wave of the horizontal polarization is transmitted from the transmission side antenna. It appears that the radiation pattern for the horizontally polarized wave has directivity in directions of 0° and 180°. Besides, it appears that the radiation pattern for the vertically polarized wave has directivity in directions of 0°, 90° and 180°. Incidentally, the meaning of an upper right picture is the same as in FIG. 9A.

Figure 9C:
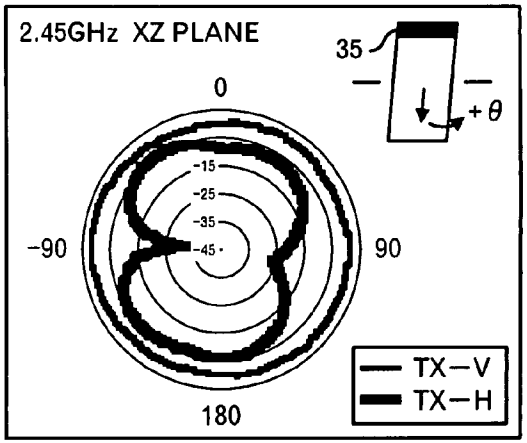

FIG. 9C shows radiation patterns when electric waves of 2.45 GHz are transmitted from the transmission side antenna, and the reception side antenna shown in FIGS. 6A and 6B is rotated while the measurement plane is set to the XZ plane. Similarly to the above, a solid line indicates the radiation pattern of the reception side antenna in the case where the electric wave of the vertical polarization is transmitted from the transmission side antenna, and a thick line indicates the radiation pattern of the reception side antenna in the case where the electric wave of the horizontal polarization is transmitted from the transmission side antenna. It appears that the radiation pattern for the horizontally polarized wave has directivity in directions of 0° and 180°. Besides, the radiation pattern for the vertically polarized wave has non-directivity. Incidentally, the meaning of an upper right picture is the same as in FIG. 9A.

Figure 9D:
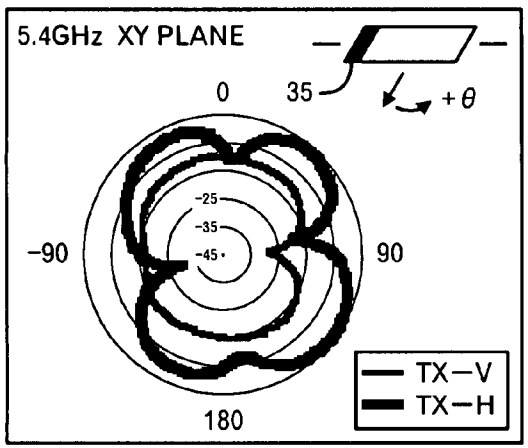
FIGS. 9D, 9E and 9F are diagrams showing radiation patterns with respect to the electric wave of 5.4 GHz in the fourth embodiment of this invention.

FIG. 9D shows radiation patterns when electric waves of 5.4 GHz are transmitted from the transmission side antenna, and the reception side antenna shown in FIGS. 6A and 6B is rotated while the measurement plane is set to the XY plane. Similarly to the above, a solid line indicates the radiation pattern of the reception side antenna in the case where the electric wave of the vertical polarization is transmitted from the transmission side antenna, and a thick line indicates the radiation pattern of the reception side antenna in the case where the electric wave of the horizontal polarization is transmitted from the transmission side antenna. It appears that the radiation pattern for the horizontally polarized wave has directivity in directions of 45°, 135°, −45° and −135°. Besides, it appears that the radiation pattern for the vertically polarized wave has non-directivity except for the direction of 90°. Incidentally, the meaning of an upper right picture is the same as in FIG. 9A.

Figure 9E:
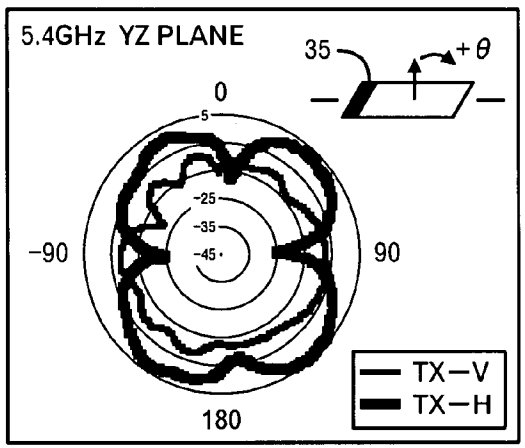

FIG. 9E shows radiation patterns when electric waves of 5.4 GHz are transmitted from the transmission side antenna, and the reception side antenna shown in FIGS. 6A and 6B is rotated while the measurement plane is set to the YZ plane. Similarly to the above, a solid line indicates the radiation pattern of the reception side antenna in the case where the electric wave of the vertical polarization is transmitted from the transmission side antenna, and a thick line indicates the radiation pattern of the reception side antenna in the case where the electric wave of the horizontal polarization is transmitted from the transmission side antenna. It appears that the radiation pattern for the horizontally polarized wave has directivity in directions of 45°, 135°, −45° and −135°. Besides, it appears that the radiation pattern for the vertically polarized wave has directivity with a complicated shape. Incidentally, the meaning of an upper right picture is the same as in FIG. 9A.

Figure 9F:
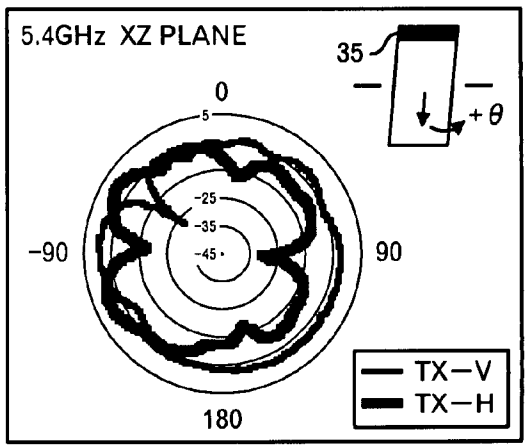

FIG. 9F shows radiation patterns when electric waves of 5.4 GHz are transmitted from the transmission side antenna, and the reception side antenna shown in FIGS. 6A and 6B is rotated while the measurement plane is set to the XZ plane. Similarly to the above, a solid line indicates the radiation pattern of the reception side antenna in the case where the electric wave of the vertical polarization is transmitted from the transmission side antenna, and a thick line indicates the radiation pattern of the reception side antenna in the case where the electric wave of the horizontal polarization is transmitted from the transmission side antenna. It appears that the radiation pattern for the horizontally polarized wave has directivity of a complicated shape. Besides, it appears that the radiation pattern for the vertically polarized wave has non-directivity except for the direction of −45°. Incidentally, the meaning of an upper right picture is the same as in FIG. 9A.

FIG. 10 collectively shows data of average gains. For each of the planes, the average gain of 2.45 GHz and the average gain for 5.4 GHz with respect to the vertically polarized wave (V) and the horizontally polarized wave (H) are indicated. Further, the total average gains for 2.45 GHz and 5.4 GHz are also indicated. From this, with respect to 2.45 GHz, the gain for the vertically polarized wave on the XZ plane is high, and with respect to the horizontally polarized wave, the gain is high on the YZ plane or the XY plane. Besides, with respect to 5.4 GHz, the gain for the horizontally polarized wave on the YZ plane or the XY plane is high, and with respect to the vertically polarized wave, the gain is relatively high on the XZ plane.

5. Embodiment 5

An antenna of a fifth embodiment of this invention is a dual band antenna for a 2.4 GHz band and a 5 GHz band, and here, a contrivance to further miniaturize the dielectric substrate 35 of the fourth embodiment will be described. The dual band antenna has a structure in which as shown in a side view of FIG. 11A, a planar first element 41 and a first portion 47*a* of a second element as a resonant element are formed in a relatively low layer of a dielectric substrate 46, second portions 47*b* of the second element are formed in a relatively high layer of the dielectric substrate 46, and they are connected by two external electrodes 46*a*. FIG. 11B shows a structure of the layer in which the first element 41 and the first portion 47*a* of the second element are formed. The shape of the first element 41 is the same as that shown in the fourth embodiment. The first portion 47*a* of the second element extends from the center of the top of the first element 41, branches out into two directions halfway, and the branch portions are connected to the two external electrodes 46*a* provided at the upper end portion of the dielectric substrate 46. FIG. 11C shows a structure of the layer in which the second portions 47*b* of the second element is formed. The second portions 47*b* of the second element have such structure that after they extend from the external electrode 46*a* provided at the upper end portion of the dielectric substrate 46 in the direction toward the lower end portion of the dielectric substrate 46, they include the meander portions shown in the fourth embodiment (FIG. 4). The second portions 47*b* of the second element are disposed so as not to overlap with the first element 41 when viewed from the above though they are provided in the different layers. Similarly to the arrangement shown in FIG. 5 in the fourth embodiment, when viewed from the above, they are disposed so as not to overlap with at least the region where a bad influence is exerted on the first element 41. That is, when the second portions 47*b* of the second element and the first element 41 are projected on a virtual plane parallel to the layers in which they are formed, the second portions 47*b* of the second element are disposed not to overlap with predetermined regions defined beside the first element projected on the virtual plane. The predetermined regions are portions corresponding to the regions 38 shown in FIG. 5. Incidentally, as for the size of the dielectric substrate 46 in this embodiment, L10=1 mm, L11=4 mm, and L12=10 mm.

The resonant frequency of the second element is controlled by adjusting the length of the second element from a connected portion with the first element 41 to the open ends. When compared with the fourth embodiment, the portions, as the first portions 47*a* of the second element, extending toward the external electrodes 46*a*, the portions of the external electrodes 46*a*, and the portions, as the second portions 47*b* of the second element, vertically extending from the external electrodes 46*a* are added as the length of the second element. Thus, even if the second portions 47*b* of the second element are shortened, the characteristic of the 2.4 GHz band can be kept at the same level as the antenna of the fourth embodiment. By this structure, miniaturization of the dielectric substrate 46 can be realized.

Figure 12:
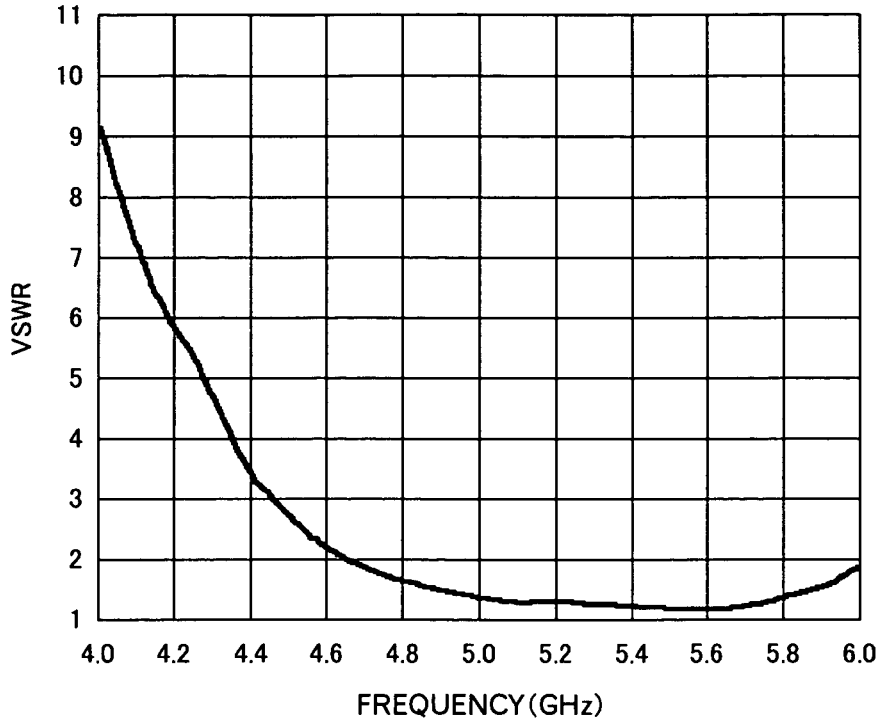
FIG. 12 is a diagram showing an impedance characteristic of a 5 GHz band in the fifth embodiment of this invention.

FIG. 12 shows the impedance characteristic of the 5 GHz band in this embodiment. In FIG. 12, the axis of ordinate indicates the VSWR, and the axis of abscissa indicates the frequency (GHz). When compared with FIG. 8 showing the impedance characteristic of the 5 GHz band according to the fourth embodiment, although the shape of the curved line is slightly different, the bandwidth in which the VSWR is 2 or less is almost identical.

Figure 13:
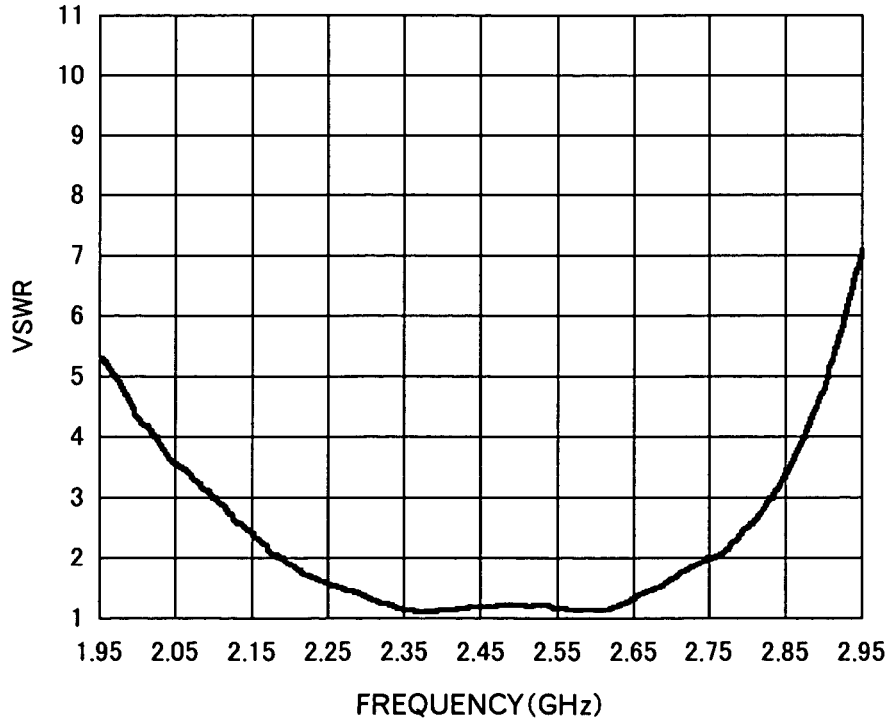
FIG. 13 is a diagram showing an impedance characteristic of a 2.4 GHz band in the fifth embodiment of this invention.

FIG. 13 shows the impedance characteristic of the 2.4 GHz band in this embodiment. In FIG. 13, the axis of ordinate indicates the VSWR, and the axis of abscissa indicates the frequency (GHz). When compared with FIG. 7 showing the impedance characteristic of the 2.4 GHz band according to the fourth embodiment, the bandwidth in which the VSWR is 2 or less, in FIG. 13 showing the miniaturized case becomes wider at the high frequency side by about 80 MHz. Thus, it is understood that the excellent characteristic is represented as stated above.

6. Embodiment 6

Figure 14A:
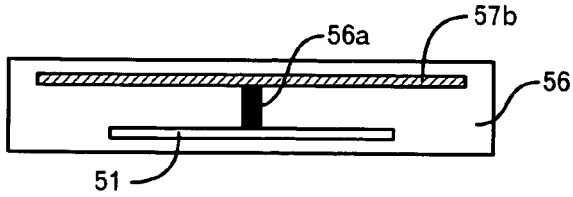
FIGS. 14A, 14B and 14C are diagrams showing a layer structural example of a dielectric substrate for an antenna according to a sixth embodiment of this invention.
Figure 14B:
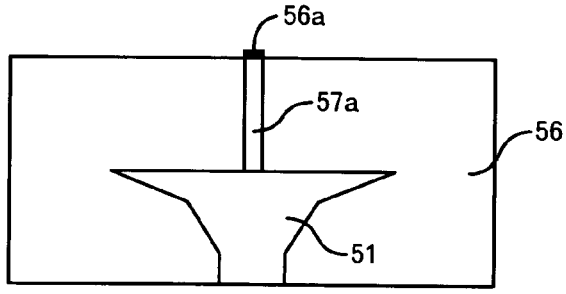
Figure 14C:
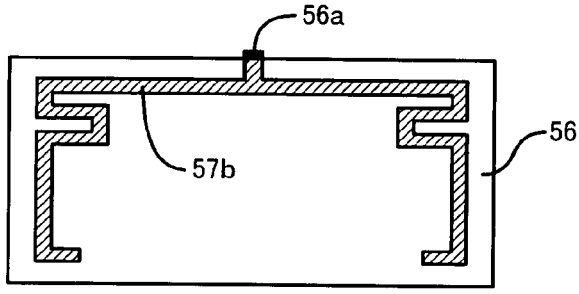

An antenna of a sixth embodiment of this invention is a dual band antenna for a 2.4 GHz band and a 5 GHz band, and here, a contrivance to further miniaturize the dielectric substrate 35 of the fourth embodiment will be described. The dual band antenna has a structure in which as shown in a side view of FIG. 14A, a planar first element 51 and a first portion 57*a* of a second element as a resonant element are formed in a relatively low layer of a dielectric substrate 56, a second portion 57*b* of the second element is formed in a relatively high layer of the dielectric substrate 56, and they are connected to each other by one external electrode 56*a*. FIG. 14B shows a structure of the layer in which the first element 51 and the first portion 57*a* of the second element are formed. The shape of the first element 51 is the same as that shown in the fourth embodiment. The first portion 57*a* of the second element extends from the center of the top of the first element 51, and is linearly connected to the external electrode 56*a* provided at the upper end portion of the dielectric substrate 56. FIG. 14C shows a structure of the layer in which the second portion 57*b* of the second element is formed. The second portion 57*b* of the second element has such a structure that after it extends from the external electrode 56*a* provided at the upper end portion of the dielectric substrate 56 in the direction toward the lower end portion of the dielectric substrate 56, it includes most of the second element 37 shown in the fourth embodiment (FIG. 4) except for the portion for connection to the first element 31. The second portion 57*b* of the second element is disposed so as not to overlap with the first element 51 when viewed from the above though they are provided in the different layers. Similarly to the arrangement shown in FIG. 5 in the fourth embodiment, when viewed from the above, it is disposed so as not to overlap with at least the region where a bad influence is exerted on the first element 51.

The resonant frequency of the second element is controlled by adjusting the length of the second element from a connected portion with the first element 51 to the open ends. When compared with the fourth embodiment, the portion, as the first portion 57*a* of the second element, extending toward the external electrode 56*a*, the portion of the external electrode 56*a*, and the portion, as the second portion 57*b* of the second element, vertically extending from the external electrode 56*a* are added as the length of the second element. Thus, even if the second portion 57*b* of the second element is shortened, the characteristic of the 2.4 GHz band can be kept at the same level as the antenna of the fourth embodiment. By this structure, miniaturization of the dielectric substrate 56 can be realized.

7. Embodiment 7

Figure 15A:
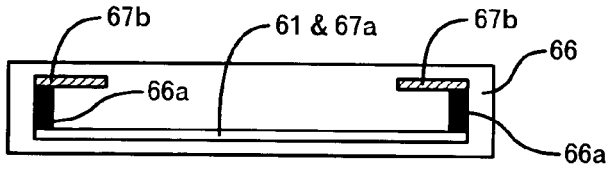
FIGS. 15A, 15B and 15C are diagrams showing a layer structural example of a dielectric substrate for an antenna according to a seventh embodiment of this invention.
Figure 15B:
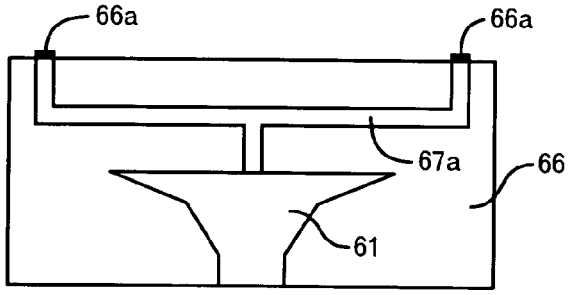
Figure 15C:
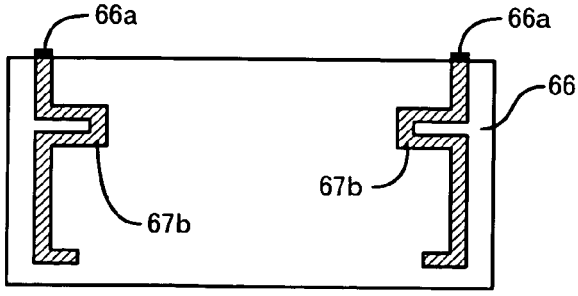
Figure 16A:
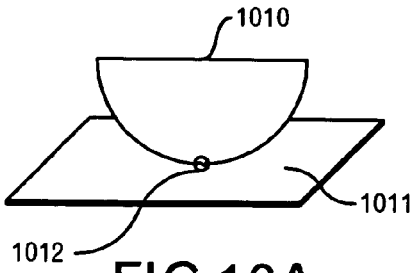
FIGS. 16A, 16B and 16C are diagrams showing structures of conventional antennas.
Figure 16B:
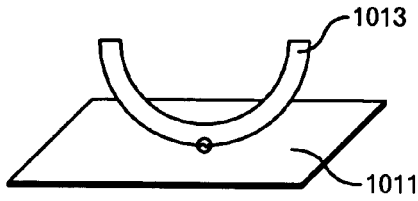
Figure 16C:
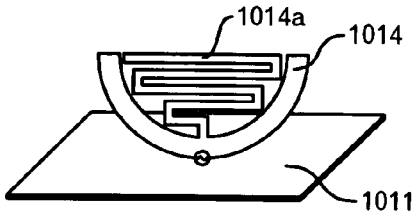
Figure 17:
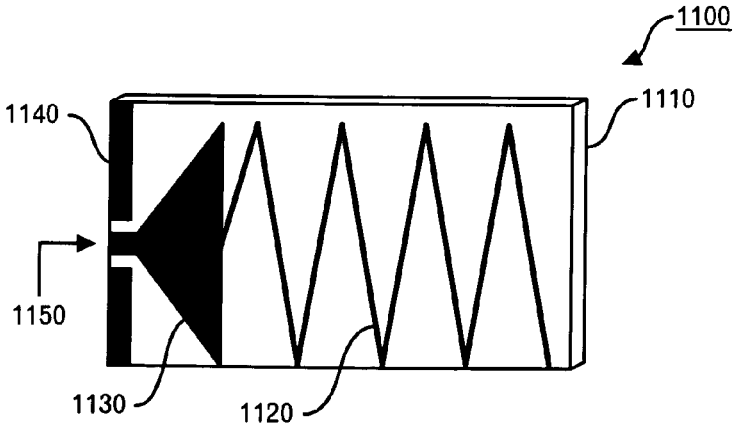
FIG.17 PRIOR ART
FIG. 17 is a diagram showing a structure of a conventional antenna.

An antenna of a seventh embodiment of this invention is a dual band antenna for a 2.4 GHz band and a 5 GHz band, and here, a contrivance to further miniaturize the dielectric substrate 35 of the fourth embodiment will be described. The dual band antenna has a structure in which as shown in a side view of FIG. 15A, a planar first element 61 and a first portion 67*a* of a second element as a resonant element are formed in a relatively low layer of a dielectric substrate 66, second portions 67*b* of the second element are formed in a relatively high layer of the dielectric substrate 66, and they are connected via two external electrodes 66*a*. FIG. 15B shows a structure of the layer in which the first element 61 and the first portion 67*a* of the second element are formed. The shape of the first element 61 is the same as that shown in the fourth embodiment. The first portion 67*a* of the second element extends from the center of the top of the first element 61, branches out into two directions halfway, and the branch portions extend beyond the side width of the first element 61, and then, they are connected to the two external electrodes 66*a* provided at the upper end portion of the dielectric substrate 66. FIG. 15C shows a structure of the layer in which the second portions 67*b* of the second element are formed. The second portions 67*b* of the second element have such structure that after they extend from the external electrodes 66*a* provided at the upper end portion of the dielectric substrate 66 in the direction toward the lower end portion of the dielectric substrate 66, they include the meander portions. The second portions 67*b* of the second element are disposed so as not to overlap with the first element 61 when viewed from the above though they are provided in the different layers. Similarly to the arrangement shown in FIG. 5 in the fourth embodiment, when viewed from the above, they are disposed so as not to overlap with at least the regions where a bad influence is exerted on the first element 61.

The resonant frequency of the second element is controlled by adjusting the length of the second element from a connected portion with the first element 61 to the open ends. When compared with the fourth embodiment, the portions, as the first portion 67*a* of the second element, extending toward the external electrodes 66*a*, the portions of the external electrodes 66*a*, and the portions, as the second portions 67*b* of the second element, vertically extending from the external electrodes 66*a* are added as the length of the second element. Thus, even if the second portions 67*b* of the second element are shortened, the characteristic of the 2.4 GHz band can be kept at the same level as the antenna of the fourth embodiment. By this structure, miniaturization of the dielectric substrate 66 can be realized.

Although the embodiments of the invention have been described, the invention is not limited to these. For example, as the shape of the planar element and the resonant element, a different shape can be adopted as long as a similar antenna characteristic can be obtained. Besides, as the tapered shape of the ground pattern, although the example in which the upper edge portion is the straight line has been described, a curved line convex upwardly or downwardly may be adopted. Besides, there is also a case where a recess for accommodating an electrode for feeding is provided in the upper edge portion of the ground pattern. Further, an implementation example is not limited to that shown in FIG. 6. That is, implementation can also be performed on a wireless communication card, such as a PC card or a compact flash (registered trademark) (CF) card, which is inserted in a slot of a personal computer or a PDA (Personal Digital Assistant)

and is used. For adjustment of the antenna characteristic at the time of the implementation, the ground pattern may be extended up to the right or the left of the dielectric substrate. Besides, two dielectric substrates may be provided on upper end portions of a substrate so that they do not interfere with each other, and a space diversity antenna may be structured. Further, the dielectric substrate can be mounted on a small stick type card.

Although the present invention has been described with respect to a specific preferred embodiment thereof, various change and modifications may be suggested to one skilled in the art, and it is intended that the present invention encompass such changes and modifications as fall within the scope of the appended claims.

What is claimed is:

1. An antenna, comprising:

a planar element that is fed at a feed position; and a ground pattern that is juxtaposed with said planar element, and wherein a distance between said planar element and said ground pattern is gradually increased so that the increase of said distance becomes saturated as being farther away from a straight line passing through said feed position, said antenna further comprises a resonant element connected to an end point of said planar element on said straight line passing through said feed position of said planar element, said planar element and said resonant element are symmetrical with respect to said straight line passing through said feed position of said planar element, and said planar element and said resonant element are formed on or inside a dielectric substrate.

2. The antenna as set forth in claim 1, wherein a side edge portion of said planar element is constituted by either one of a curved line and a plurality of line segments, which are connected while their inclinations are changed stepwise.

3. The antenna as set forth in claim 1, wherein said planar element and said resonant element is formed in a same layer of said dielectric substrate.

4. The antenna as set forth in claim 1, wherein said planar element and at least a part of said resonant element is formed in different layers.

5. The antenna as set forth in claim 1, wherein when said planar element and said resonant element are projected on a virtual plane parallel to layers in which the respective elements are formed, said resonant element is disposed without overlapping with a predetermined region defined beside said planar element projected on said virtual plane.

6. The antenna as set forth in claim 1 wherein when said planar element and said resonant element are projected on a virtual plane parallel to layers in which the respective elements are formed, said resonant element is disposed without overlapping with at least a region at a planar element side with respect to a half line, which is parallel to said straight line passing through said feed position of the projected planar element and extends in a feed position direction from a start point that is an end point of said side edge portion of the projected planar element and is a point remoter from said feed position.

7. A dielectric substrate for an antenna, comprising:

a dielectric layer; and a layer including a conductive planar element having a side edge portion constituted by either one of a curved line and line segments, which are connected while their inclinations are changed stepwise, and wherein a distance between a side surface closest to a feed position of said planar element among side surfaces of said dielectric substrate and said side edge portion is gradually increased so that the increase of said distance becomes saturated as being farther away from a straight line passing through said feed position, said dielectric substrate further comprises a resonant element connected to an end point of said planar element on said straight line passing through said feed position of said planar element, and said resonant element is symmetrical with respect to said straight line passing through said feed position of said planar element.

8. The dielectric substrate as set forth in claim 7, wherein said planar element and said resonant element are formed in a same layer of said dielectric substrate.

9. The dielectric substrate as set forth in claim 7, wherein said planar element and at least a part of said resonant element are formed in different layers of said dielectric substrate.

10. The dielectric substrate as set forth in claim 7, wherein when said planar element and said resonant element are projected on a virtual plane parallel to layers in which the respective elements are formed, said resonant element is disposed without overlapping with a predetermined region defined beside said planar element projected on said virtual plane.

11. The dielectric substrate as set forth in claim 7, wherein when said planar element and said resonant element are projected on a virtual plane parallel to layers in which the respective elements are formed, said resonant element is disposed without overlapping with at least a region at a planar element side with respect to a half line, which is parallel to said straight line passing through said feed position of the projected planar element and extends in a feed position direction from a start point that is an end point of said side edge portion of the projected planar element and is a point remoter from said feed position.

12. An antenna comprising:

a planar element that is fed at a feed position;

a ground pattern that is juxtaposed with said planar element; and a second element that is connected with said planar element, wherein said second element is connected with a first edge part of said planar element, said first edge part being opposite to a second edge part of said planar element, said second edge part being adjacent to said ground pattern, and said planar element and said second element are symmetrical with respect to said straight line passing through said feed position of said planar element.

* * * * *